US006920701B2

(12) United States Patent
Haseley et al.

(10) Patent No.: US 6,920,701 B2
(45) Date of Patent: Jul. 26, 2005

(54) CHAMBER FOR A FREEZE-DRYING DEVICE

(75) Inventors: Peter Haseley, Meckenheim (DE); Georg-Wilheim Oetjen, Lübeck (DE)

(73) Assignee: Steris GmbH, Hurth (DE)

( * ) Notice: Subject to any disclaimer, the term of this patent is extended or adjusted under 35 U.S.C. 154(b) by 0 days.

(21) Appl. No.: 10/485,032

(22) PCT Filed: Jul. 15, 2002

(86) PCT No.: PCT/EP02/07828

§ 371 (c)(1),
(2), (4) Date: Aug. 4, 2004

(87) PCT Pub. No.: WO03/012355

PCT Pub. Date: Feb. 13, 2003

(65) Prior Publication Data

US 2004/0250441 A1 Dec. 16, 2004

(30) Foreign Application Priority Data

Jul. 27, 2001 (DE) ..... 101 36 498

(51) Int. Cl.[7] ..... F26D 13/30
(52) U.S. Cl. ..... 34/92
(58) Field of Search ..... 34/284, 92; 62/532, 62/123; 516/113; 264/5

(56) References Cited

U.S. PATENT DOCUMENTS

| | | | | |
|---|---|---|---|---|
| 3,048,928 A | | 8/1962 | Copson et al. | |
| 3,311,991 A | * | 4/1967 | Gidlow et al. | 34/292 |
| 5,822,882 A | * | 10/1998 | Anger | 34/296 |
| 5,964,043 A | * | 10/1999 | Oughton et al. | 34/92 |
| 6,163,979 A | * | 12/2000 | Oetjen et al. | 34/286 |

FOREIGN PATENT DOCUMENTS

| | | | |
|---|---|---|---|
| DE | 19719398 | 12/2000 | F26B/21/10 |
| GB | 1032857 | 6/1966 | F26B/5/06 |
| WO | WO 97/08503 | 3/1997 | F26B/5/06 |

* cited by examiner

*Primary Examiner*—Stephen Gravini
(74) *Attorney, Agent, or Firm*—Kusner & Jaffe; Michael A. Centanni

(57) ABSTRACT

A chamber for a freeze-drying device with storage surfaces, whose temperature can be regulated, for containers containing the product that is to be freeze-dried. The chamber includes an optical shield comprised of shield components, whose temperature can be regulated. The shield is positioned between the storage surfaces and the interior wall surfaces of the chamber.

12 Claims, 1 Drawing Sheet

CHAMBER FOR A FREEZE-DRYING DEVICE

FIELD OF THE INVENTION

The invention relates to a chamber for a freeze-drying device with storage surfaces whose temperature can be regulated for containers that carry the product that is to be freeze-dried.

BACKGROUND OF THE INVENTION

Freeze-drying has gained ground especially in the pharmaceutical industry for the preservation of medications, vaccines etc. In the chambers of modern freeze-drying devices, a plurality of storage plates are located, the storage plates having storage surfaces that can accommodate a multitude of containers, bottles or the like (100,000 or more). The product, which is generally dissolved in water, is filled into containers of this type. Before starting the freeze-drying process, the liquid is frozen. This step generally already occurs in the chamber of the freeze-drying unit by cooling the storage surfaces to an accordingly low temperature (−40° C. to −60° C.).

German disclosure document 197 19 298 (U.S. Pat. No. 6,163,979 to Oetjen et al.) discloses a chamber of the aforementioned kind. Moreover, the German document explains a method for controlling the freeze-drying process in the chamber. The characteristics of the course of the drying process are essentially two drying phases. As long as there is still crystalline (frozen) water within the product, the drying phase is referred to as the main or sublimation drying process. When water is no longer present in the form of ice, the remaining water has been absorbed by the dry product or more or less firmly bonded thereto as well. Removal of this remaining water takes place during the subsequent, after drying or desorption drying process. To control a freeze-drying process of this type, certain chamber pressures and storage surface temperatures must be obtained. An essential parameter is the ice temperature, which can be determined by measurements of pressure increase.

Controlling the ice temperature in the sublimation surface via the pressure assumes that a uniform water vapor partial pressure exists in the chamber. This uniform pressure distribution is possible only to a limited extent in the area of the chamber walls as well as the chamber door or doors. In these areas, the temperature of the product that is located in the bottles depends not only on the storage plate temperature, but is also affected by the temperature of the interior walls of the chamber through thermal radiation. If, for example, the water vapor being released from the product has a temperature of −40° C., then the temperature on the storage plates increases, for example, to −20° C., while the water vapor in the vicinity of the walls, for example, reaches 20° C. Due to these differences in temperature, pressure differences of more than 10% can develop. The desired prerequisite that a uniform water vapor partial pressure be maintained in the chamber is no longer met with sufficient accuracy; the ice temperature that develops is no longer uniform. Product quality losses are the resulting consequence.

In order to avoid the influence of the chamber wall temperature on the temperature of the product contained in the bottles, it is known to equip the storage plates with an outer rim, which protects the product from heat radiation originating from the chamber walls. These measures, however, have had only limited success because the differences in temperature between the rim and the storage surfaces are about 20° C.

Moreover the suggestion has been made to regulate the temperatures of the walls and door(s) of the chamber. These measures, however, are associated with practically unsolvable technical difficulties and economic disadvantages. The chamber with its door(s) in production facilities can, especially if vapor sterilization is required, reach a mass of many tons. Said masses would have to be cooled down to −40° C. and often even down to −60° C. during the freezing process, which leads either to an impermissibly long freezing time or to separate cooling systems, which have to achieve a multiple of the cooling output that is required for the storage plates and the product. Apart from these economic problems, it is technically difficult to cool the flanges on the chamber and the flange on the door to e.g. −50° C. The seals between the chamber and the door must remain functional at low temperatures, and it is difficult to avoid water vapor condensation on said flanges. Insulating the flange against water vapor condensation is technically not possible because the chamber flange and the door are located in sterile rooms. The sterility requirements in a clean room exclude the use of insulating materials that would be suitable for these low temperatures.

The present invention proposes a chamber for a freeze-drying device of the aforementioned kind that maintains uniform temperature conditions and water vapor pressure conditions during the freeze-drying process without special technical modifications.

SUMMARY OF THE INVENTION

The present invention provides an optical shield, comprised of a plurality of components whose temperature can be regulated, which optical shield is positioned between the storage surfaces and the interior surfaces of the chamber. While performing the freeze-drying process, the components of the optical shield, whose temperature can be regulated, are always adjusted to the temperature of the storage surfaces. The chamber wall temperatures can no longer influence the temperature of the product contained in the bottles. No measurable temperature and water vapor pressure differences exist in the interior space that is defined by the optical shield components.

BRIEF DESCRIPTION OF THE DRAWINGS

Further benefits and details of the invention shall be explained based on an exemplary embodiment, which is depicted in diagrammatic form in FIGS. 1 and 2. It shows.

DETAILED DESCRIPTION OF PREFERRED EMBODIMENT

Figure 1:
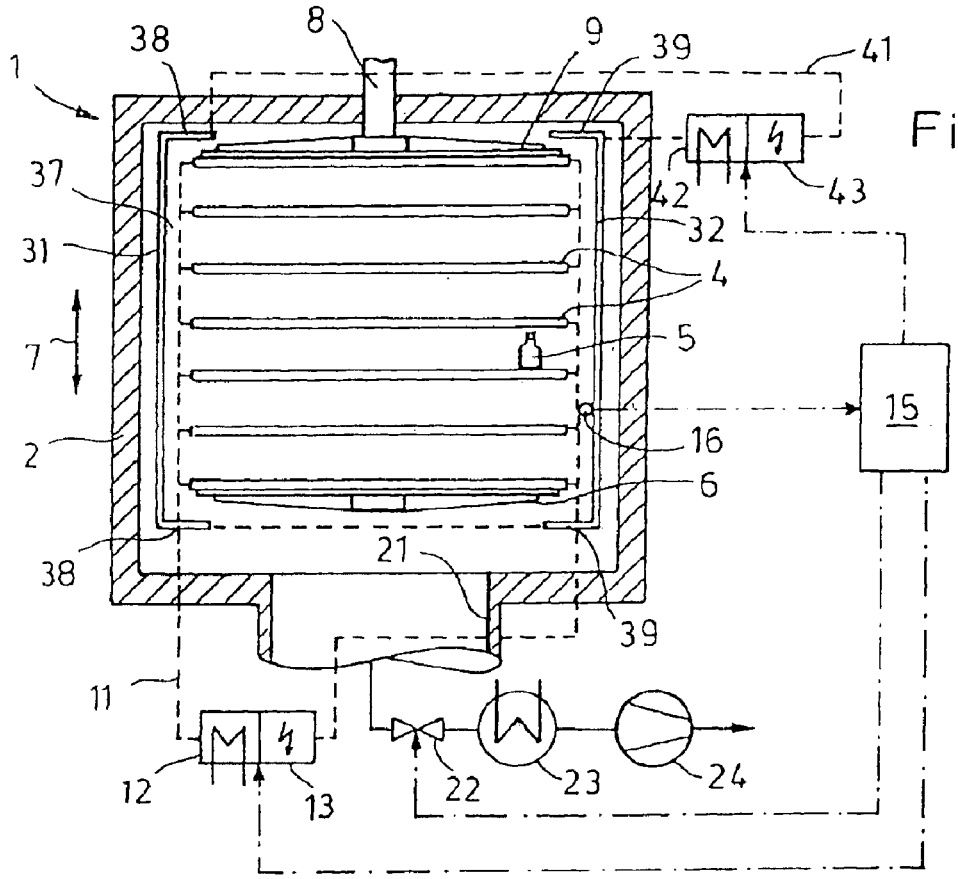
FIG. 1 a vertical section through a chamber pursuant to the invention.

In the drawings, a freeze-drying device includes a chamber 1, having a chamber wall 2, a door 3 (FIG. 2), and storage plates 4 that are located in chamber 1. An exemplary bottle 5 is shown in the drawings placed onto a storage plate 4. The lower storage plate 4 is supported by a stationary base plate 6. The remaining storage plates 4 can be displaced back and forth (double arrow 7) such that their distance can be modified. By sliding the storage plates 4, e.g. with the help of a hydraulic drive (piston rod 8), the bottle 5 is closed in the known fashion with stoppers. The stoppers that are placed onto the bottles 5 before starting the freeze-drying process, contain laterally ending through-channels for the water vapor. The uppermost storage plate 4 is attached to the platen 9 of the piston rod 8.

The storage plates 4 are part of a temperature-adjusting system 11, indicated with dotted lines. A brine flows through it, which is cooled with a heat exchanger 12 (connected to a refrigerating machine, which is not depicted) or heated with a heater 13, as needed. To control the course of the freeze-drying process, a control unit 15 shown as a block is provided, to which among other things signals of a pressure sensor 16 that is positioned in the chamber can be fed as the control variable. At the beginning of the freeze-drying process, the storage plates 4 are initially cooled (freezing phase). During the drying phases, the storage plates 4 have temperatures over 0° C. in order to accelerate the vaporization process.

The chamber 1 is equipped with a connecting piece 21, to which a condenser 23 and a vacuum pump 24 are connected via a valve 22. The condenser 23 serves the condensation of the water vapor, which precipitates during the freeze-drying process. Gases that are not condensable are removed by the vacuum pump 24. The valve 22 is connected to the control unit 15. It is closed at times to be able to determine the ice temperature with the help of pressure increase measurements.

In accordance with the present invention, a shield is provided between the storage surfaces of storage plates 4 and the interior surfaces of the chamber wall 2. The shield is comprised of several shield components, designated 31, 32, 33, 34, 35 and 36 in the drawings, that enclose the storage plates 4 such that no visual connection exists between the storage surfaces (and the bottles 5 placed thereupon) on one hand and the interior wall surfaces of chamber 1 on the other hand. The distances selected between the respective components are dimensioned large such that the movement of water vapor between the storage surfaces and the connecting piece 21 can occur essentially unimpaired. It is therefore also expedient if the individual shield components overlap similar to blinds.

In the embodiment shown, components 31 through 36 enclose the storage package from all sides. From above and below, the upper or lower storage plates 4 provide the desired visual protection and temperature regulation. If, for example, the upper storage plate 4 is not included, one or more additional components must be provided to ensure optical shielding toward the upper chamber wall.

Through the inventive components, an interior, outwardly visually sealed space 37 is created, in which the storage plates 4 or the storage surfaces for the bottles 5 are located. Radiation heat originating from the interior wall surfaces of the chamber can no longer influence the temperature and pressure conditions in the space 37. During the course of the freeze-drying process, the desired pressure levels and temperatures develop uniformly in the space 37.

Figure 2:
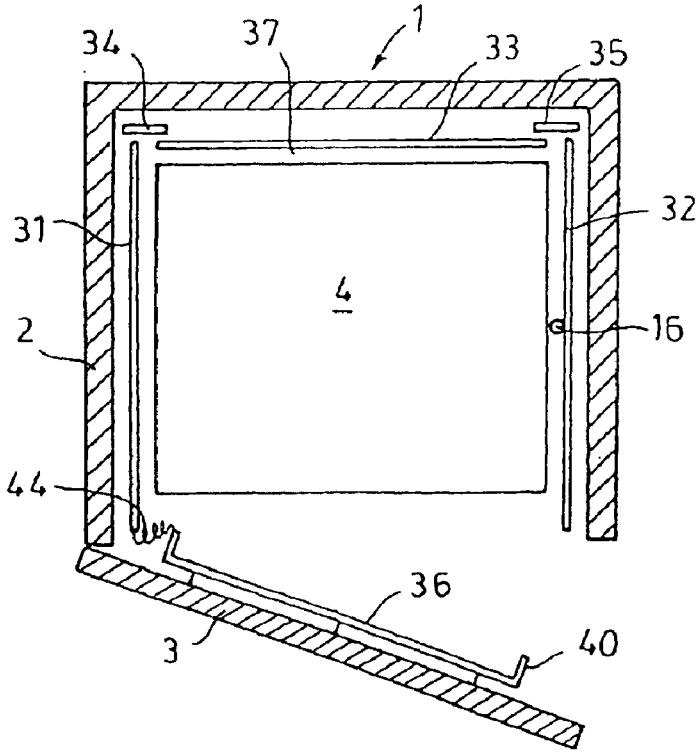
FIG. 2 a horizontal section through said chamber.

In order to achieve optimal shielding of the storage surfaces of storage plate 4 in the edge areas thereof, the components 31, 32 comprise top and bottom end sections that are bent, as best seen in FIG. 1. An alternative embodiment is shown in FIG. 2. In the area of the rear edges of the storage plates 4 assembly, gaps exist at the ends of the components 31, 33 or 32, 33, respectively, which gaps do not impair the vapor flow. The gaps are assigned, at sufficient space, additional components 34, 35, preferably between the gaps and the chamber wall 2. The width and length of components 34, 35 are selected such that a visual connection between the storage surfaces and the interior wall of the chamber through the gaps does not exist.

In accordance with another aspect of the present invention, a component 36 is attached to the door 3 of the chamber 1. Component 36 is designed such that a visual connection between the storage surfaces and the inside surface of the door does not exist. Bent sections 40 ensure the necessary overlapping of the shield components in the area of the front edge of the storage plate assembly.

The temperature of the aforementioned shield components 31 through 36 is regulated. They are designed as relatively thin (less than 1 cm), double-wall plates and a heating/cooling medium flows through them. It is useful if the plates have as low a thermal capacity as possible, and may be comprised of stainless steel.

FIG. 1 depicts a circuit 41, which comprises a heat exchanger 42 and heater 43 that is independent from the temperature circuit 11 for the storage plates 4. All shield components are part of said circuit 41. The component 36, which is fastened to the chamber wall 3, is also supplied via flexible connecting lines 44 (FIG. 2).

It is also possible to integrate the shield components in the storage plate circuit 11. Due to different power requirements, that are offset with regard to time, however, two separate circuits 11 and 41 are preferable. The control of the circuit 41 is also achieved by the control block 15.

The figures also show that a pressure sensor 16 is located within the space 37. The pressure 16 in said space 37, being the control variable, is essential. The pressure outside the space 37 is not essential for the controlled course of the freeze-drying process.

What is claimed is:

1. A freeze-dryer for freeze-drying a product, the freeze-dryer comprising:

a chamber having interior wall surfaces;

means connected to said chamber for producing a vacuum in said chamber;

a temperature controlled storage surface for receiving a container disposed within said chamber; and a plurality of temperature controlled shield components, said shield components disposed about said storage surface and said container such that no direct path exists between said container and said interior walls, and said shield components being spaced apart from each other such that vapor flow is permitted therebetween.

2. Chamber pursuant to claim 1 characterized in that said plurality of temperature controlled shield components are equipped with bent sections.

3. Chamber pursuant to claim 1 comprising a chamber door, characterized in that an interior wall of said door carries at least one of said plurality of temperature controlled shield components.

4. Chamber pursuant to claim 1 characterized in that a pressure sensor is disposed relative to said plurality of temperature controlled shield components such that no direct path exists between said pressure sensor and said interior walls.

5. Chamber pursuant to claim 1, characterized in that said temperature controlled shield components are double-wall plates and are part of a cooling medium circuit.

6. Chamber pursuit to claim 5, characterized in that said plurality of temperature controlled shield components are equipped with bent sections.

7. Chamber pursuant to claim 5, characterized in that the distances between said plurality of temperature controlled shield components are dimensioned such that water vapor transport between said storage surfaces and a condenser that is connected to said chamber is essentially unimpaired.

8. Chamber pursuant to claim 5, characterized in that said storage surfaces and said plurality of temperature controlled shield components are part of a common cooling circuit.

9. Chamber pursuant to claim 5, characterized in that said storage surfaces and said plurality of temperature controlled shield components are parts of independent cooling circuits.

10. Chamber pursuant to claim 5, comprising a chamber door, characterized in that an interior wall of said door carries at least one of said plurality of temperature controlled shield components.

11. Chamber pursuant to claim 1, characterized in that said plurality of temperature controlled shield components are arranged such that they overlap.

12. Chamber pursuit to claim 11, characterized in that said plurality of temperature controlled shield components are equipped with bent sections.

* * * * *